US007082278B2

(12) United States Patent
Muramatsu

(10) Patent No.: US 7,082,278 B2
(45) Date of Patent: Jul. 25, 2006

(54) VARIABLE MAGNIFICATION REFLECTING MIRROR APPARATUS

(75) Inventor: Shigeki Muramatsu, Kakegawa (JP)

(73) Assignee: NEC Corporation, Tokyo (JP)

( * ) Notice: Subject to any disclaimer, the term of this patent is extended or adjusted under 35 U.S.C. 154(b) by 253 days.

(21) Appl. No.: 10/716,400

(22) Filed: Nov. 20, 2003

(65) Prior Publication Data

US 2004/0175205 A1 Sep. 9, 2004

(30) Foreign Application Priority Data

Nov. 22, 2002 (JP) ..... 2002-339796

(51) Int. Cl.
*G03G 15/041* (2006.01)

(52) U.S. Cl. ..... 399/202; 355/57

(58) Field of Classification Search ..... None
See application file for complete search history.

(56) References Cited

U.S. PATENT DOCUMENTS 4,424,534 A * 1/1984 Nagane ..... 358/451
4,812,917 A * 3/1989 Suzuki ..... 358/451
5,845,019 A * 12/1998 Yoshizawa et al. ..... 382/312
6,124,952 A * 9/2000 Shieh et al. ..... 358/475
6,141,134 A * 10/2000 Wu et al. ..... 359/210
6,160,641 A * 12/2000 Kaneko et al. ..... 358/484
6,421,158 B1 * 7/2002 Yeh ..... 359/212

FOREIGN PATENT DOCUMENTS

JP 57133447 A * 8/1982
JP 6-27539 A 2/1994
JP 11-305356 A 11/1999
JP 2001-109079 A 4/2001

* cited by examiner

*Primary Examiner*—Robert Beatty
(74) *Attorney, Agent, or Firm*—Sughrue Mion, PLLC

(57) ABSTRACT

An original reading apparatus can realize stepwise or sequential variable magnification using relatively small size optical system upon reading an original. The apparatus includes a first mirror arranged in an optical path from a reading position of an original to an image forming portion across an image forming lens and reflecting a light from the reading position of the original, and a second mirror arranged with placing a reflection surface in opposition to a reflection surface of the first mirror and reflecting a light reflected from the first mirror for a plurality of times between the first and second mirrors, and thereafter reflecting toward the image forming lens. A mirror angle positioner for varying an angle of the reflection surface of at least one of the first and second mirrors depending upon a designated original reading magnification.

9 Claims, 7 Drawing Sheets

VARIABLE MAGNIFICATION REFLECTING MIRROR APPARATUS

CROSS REFERENCE TO THE RELATED APPLICATION

The present application has been filed with claiming priority based on Japanese Patent Application No. 2002-339796, filed on Nov. 22, 2002. Disclosure of the above-identified Japanese Patent Application is herein incorporated by reference.

BACKGROUND OF THE INVENTION

1. Field of the Invention

The present invention relates generally to an original reading apparatus for performing reading of an original, such as a facsimile apparatus, a copy machine, a scanner and so forth. More particularly, the invention relates to an original reading apparatus using an optical system elongating an optical path length by turning a light beam by means of a mirror.

2. Description of the Related Art

An original reading apparatus has been used not only in office but also in home in applications of electronizing of various materials, taking in image data from an exposed film and so forth. Particularly, as the original reading apparatus used in home or small scale office, compact one is preferred. Such compact original reading apparatus frequently employs a scanner module constructed with a linear image sensor in which a plurality of reading elements are aligned in a primary scanning direction, and a compressing optical system forming an image of a sheet form original or original, such as book or the like on the primary image sensor as compressed image, and a light source, as a unit for reading the image. The scanner module moves within a given casing in an auxiliary scanning direction perpendicular to the primary scanning direction. At this time, a two dimensional image information of the original mounted on a flat plate form platen glass arranged in the upper portion of the casing, is read.

On the other hand, even in such compact original reading apparatus, there is an increasing demand for reading the original with a plurality of magnifications. For instance, if it is possible to set a film on the platen glass and to read an enlarged image, it becomes unnecessary to separately buy a dedicated film scanner. Attempting to obtain images of a plurality of magnifications using the same linear image sensor, it becomes necessary to vary a distance between the original or object to a lens and a distance between the lens and the linear image sensor, and in conjunction therewith, to vary a focal distance of the lens so that the image can be formed on the linear image sensor in the condition where the distances are varied.

FIG. 7 illustrates a major portion of an optical system of the conventionally proposed copy machine disclosed in Japanese Unexamined Patent Publication No. 2001-109079. In the lower side of the platen glass 11, first and second optical scanning portions 12 and 13 arranged for reciprocal motion in lateral direction in the drawing (auxiliary scanning direction), a lens 14 arranged therebetween, a photosensitive drum 15 exposing the image and a sixth mirror 16 guiding a light output from the second optical scanning portion to the photosensitive drum 15.

The first optical scanning portion 12 is constructed with a light source 18 illuminating a linear reading position of the platen glass 11 (direction perpendicular to drawing sheet surface) and first to third mirrors 21 to 23 respectively reflecting a reflected light of the original (not shown) by illumination of the reading position by the light source 18. A light reflected by the third mirror 23 incides to the second optical scanning portion 13 via the lens 14. The second optical scanning portion 13 sequentially reflects the incident light by fourth and fifth mirrors 24 and 25 to incide the output light of the second optical scanning portion 13 to the sixth mirror 16. This arrangement of the optical system shown in FIG. 7 is to form an image of equal magnification (100%) on the photosensitive drum 15.

FIG. 8 is an illustration for explaining a relationship between a magnification and object, lens and the image forming position. Assuming that a distance between an object 31 having a length A and a lens 32 is a, and a distance between the lens 32 and an image 32 having a length B and formed at a focal position of the linear image sensor or the like is b, a magnification B/A of the image 33 can be expressed by a ratio of two distances b/a. Therefore, in the technology shown in FIG. 7, the ratio b/a of the distances is varied by individually moving the first optical scanning portion 12, the second optical scanning portion 13 and the lens 14 for setting various magnification.

FIG. 9 shows the case where a magnification is 50%, and in contrast, FIG. 10 shows the case where a magnification is 200%. As can be seen, position of the lens 14 is relatively shifted laterally (left and right direction in the drawing). By this, the ratio b/a of the distances is varied. Of course, in practical reading of the image, the first optical scanning portion 12 is moved (performs auxiliary scan) from a left side end in the drawing to a right side end relative to the platen glass 11. Associating with this, the second optical scanning portion 13 and the lens 14 are also moved with maintaining positional relationship.

Even in the technology disclosed in Japanese Unexamined Patent Publication No. 06-27539, an optical system in which light beam is sequentially turned by six mirrors, similarly, is prepared, and magnification is varied by shifting the positions of lens and mirror are shifted toward the object side or the image forming side.

On the other hand, in the technology disclosed in Japanese Unexamined Patent Publication No. 06-27539, a plurality of magnifications are stored in storage means, and these magnifications can be set easily. In addition, in the technology disclosed in Japanese Unexamined Patent Publication No. 11-305356, four mirrors are used and magnification is varied by shifting the mounting position of the lens or exchanging the lens, and in conjunction therewith shifting the focal position where the photosensitive material is arranged.

As set forth above, conventionally, in the original reading apparatus, it has been typically known to certainly obtain an optical length by sequentially turning the optical paths at respective mirrors using a plurality of mirrors in order to form the image of the original on the image sensor or the photosensitive body using relatively narrow space. Thus, upon varying magnification in stepwise manner or sequentially in the original reading apparatus set forth above, variation of magnification is achieved by varying the relative position of the lens or mirror or focal position without varying number of turns of the optical path with respect to these mirrors.

Therefore, these shifting mechanism of the original reading apparatus can be complicated. Furthermore, when the magnification of the optical system is varied significantly, shifting magnitudes of respective parts become large. On the other hand, even when a plurality of mirrors used, necessity is caused to certainly obtain sufficient length in auxiliary scanning direction in order to acquire optical path length even when a plurality of mirrors are used. As a result, the overall original reading apparatus becomes bulky to make it impossible form the compact original reading apparatus to employ the mechanism significantly varying the magnification.

SUMMARY OF THE INVENTION

Therefore, it is an object of the present invention to provide an original reading apparatus which can realize stepwise or sequential variable magnification using relatively small size optical system upon reading an original.

According to one aspect of the present invention, an original reading apparatus comprises:

a first magnification varying mirror arranged in an optical path from a reading position of an original to an image forming portion across an image forming lens and reflecting a light from the reading position of the original;

a second magnification varying mirror arranged with placing a reflection surface in opposition to a reflection surface of the first magnification varying mirror and reflecting a light reflected from the first magnification varying mirror for a plurality of times between the first and second magnification varying mirrors, and thereafter reflecting toward the image forming lens; and reflection times setting means for setting number of times between the first and second magnification varying mirrors by varying an angle of the reflection surface of at least one of the first and second magnification varying mirrors depending upon a designated original reading magnification.

Namely, with the original reading apparatus according to the present invention, angle or angles of reflection surface or reflection surfaces of one or both of first and second magnification varying mirrors are varied by reflection times setting means for varying the optical path length depending upon the original reading magnification to realize variation among a plurality of magnifications in stepwise manner or sequential manner. Since number of times of turning of the reflection light can be varied between two mirrors, down-sizing of the original reading apparatus can be accomplished in the extent corresponding to the extent of variation of the optical path length by turning. It should be noted that the present invention should not be limited to the case where the magnifications are set sequentially, but can be number of variation of magnifications in number corresponding to number of variation of number of times of turning. Of course, sequential variation of magnification in the original reading apparatus can be achieved by varying the distance between the first magnification varying mirror and the second magnification varying mirror or by varying the distance to other optical parts.

Preferably, the reflection times setting means varies angle of the reflection surface of at least one of the first and second magnification varying mirrors by rotating a motor in a magnitude corresponding to the original reading magnification set by an operating portion.

When the original reading apparatus is applied to the scanner or facsimile machine, a linear image sensor is set in an image forming portion, the first and second magnification varying mirrors, the image forming lens and a linear image sensor are assembled as single optical module, the optical module is shifted in an auxiliary scanning direction perpendicular to a primary scanning direction when the linear image sensor performing reading of an image on the original in the primary scanning direction per one line.

Since number of times of turning the reflected light between the first magnification varying mirror and the second magnification varying mirror can be set, down-sizing of the overall original reading apparatus becomes possible.

In the particular embodiment, the image forming lens is positionally fixed within the optical module, and further comprises linear image sensor moving means for moving a reading position of the image of the linear image sensor depending times of reflection when the reflection times setting means sets times of reflection depending upon the original reading magnification.

By fixing the optical lens and moving the linear image sensor by the linear image sensor moving means, the image of the reading position of the original can be formed accurately at the image reading position. It is also possible to fix the linear image sensor and to move the optical lens, or to move both.

The original reading apparatus may further comprise a position adjusting mirror reflecting a light emitted from the reading position of the original for inciding to the first magnification varying mirror and reading position adjusting means for adjusting the original reading position in the auxiliary scanning direction by controlling a rotation angle of the position adjusting mirror.

In the present invention, since number of times of turning of the reflection light between the first and second magnification varying mirrors can be varied, one or both of the reflection surfaces of these magnification varying mirrors are rotated to vary incident angles of the first magnification varying mirrors. By this, when magnification is differentiated, the original reading position can be varied in the auxiliary scanning direction. Therefore, when the original reading position is required to be constant irrespective of magnification, the rotation angle of the position adjusting reflection mirror is controlled.

When the original reading position is located on the surface of a platen glass, on which the original is mounted, when the sheet form original is tightly contacted with the platen glass, focus can be established by positioning of the object.

On the other hand, the original reading position located at a position away from a surface of a platen glass, is effective in the case where a film surface is located at a position distanced from the platen glass by a given distance. Particularly, when the image is to be read with expansion, strict setting of the reading position becomes possible. This is practically advantageous for the original reading apparatus has the original reading position different from the reading position of the sheet form original.

The original reading apparatus may further comprise optical path varying means deflecting a light reflected from the second magnification varying mirror to the longitudinal direction of the optical module, and the image forming lens is arranged between the optical path varying means and the linear image sensor. With such constriction, when the linear image sensor is small in certain extent, length of the optical module in the auxiliary scanning direction can be set shorter. As a result, the length of the original reading apparatus in auxiliary scanning direction can be shortened. On the other hand, by deflecting the light in parallel to the platen glass instead of downward direction of the platen glass perpendicular to the optical module, length of the optical module in this direction can be shortened to reduce thickness of the original reading apparatus.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of an original reading apparatus according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscurity of the present invention.

Figure 1:
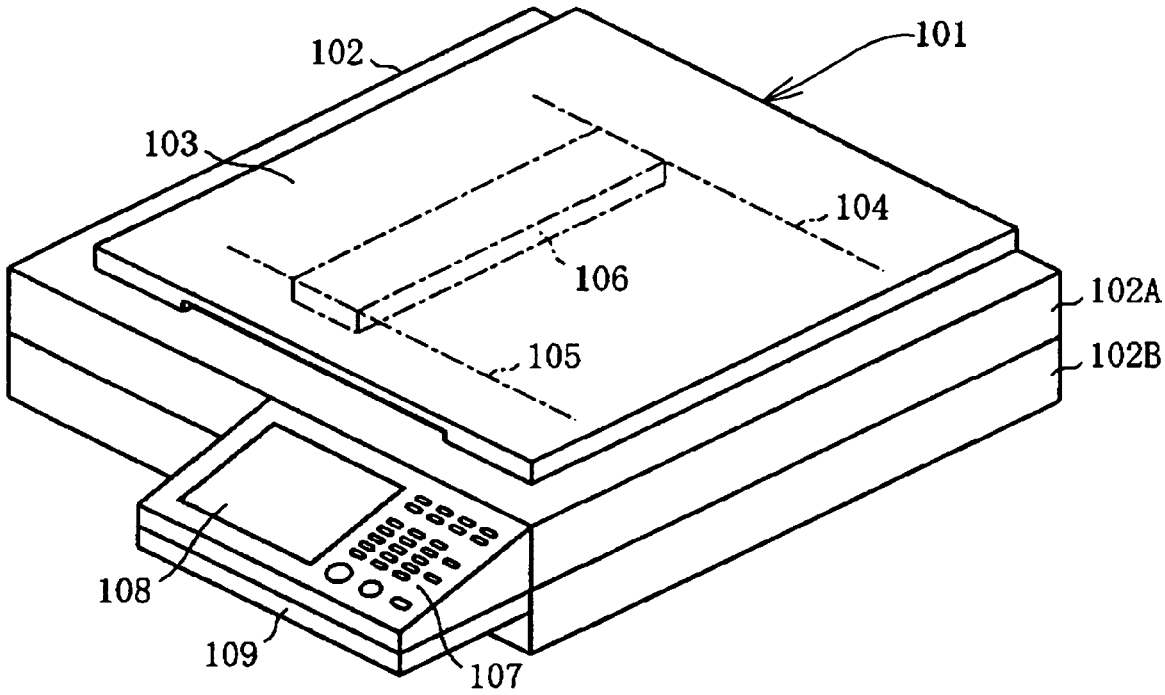
FIG. 1 is a perspective view showing an external appearance of one embodiment of an original reading apparatus according to the present invention.

FIG. 1 illustrates an external appearance of one embodiment of an original reading apparatus according to the present invention. The show embodiment of the original reading apparatus 101 has a cover 103 arranged on an upper surface of an apparatus body 102 for opening and closing. Below the cover 103, a not shown platen glass is present. Below the platen glass, a pair of guide rails 104 and 105 are arranged in parallel with each other. On these guide rails 104 and 105, a scanner module (optical module) 106 for performing reading of an image is fitted thereover and is reciprocally driven in an auxiliary scanning direction as length direction of the guide rails 104 and 105, by a not shown driving source.

The apparatus body 102 has a structure, in which an upper body portion 102A and a lower body portion 102B are stacked vertically. In the front side of the upper body portion 102A in the drawing, a control panel 109 having an operating portion 107 performing operation for reading the image and a display portion 108 for performing necessary display on an operation surface.

Figure 2:
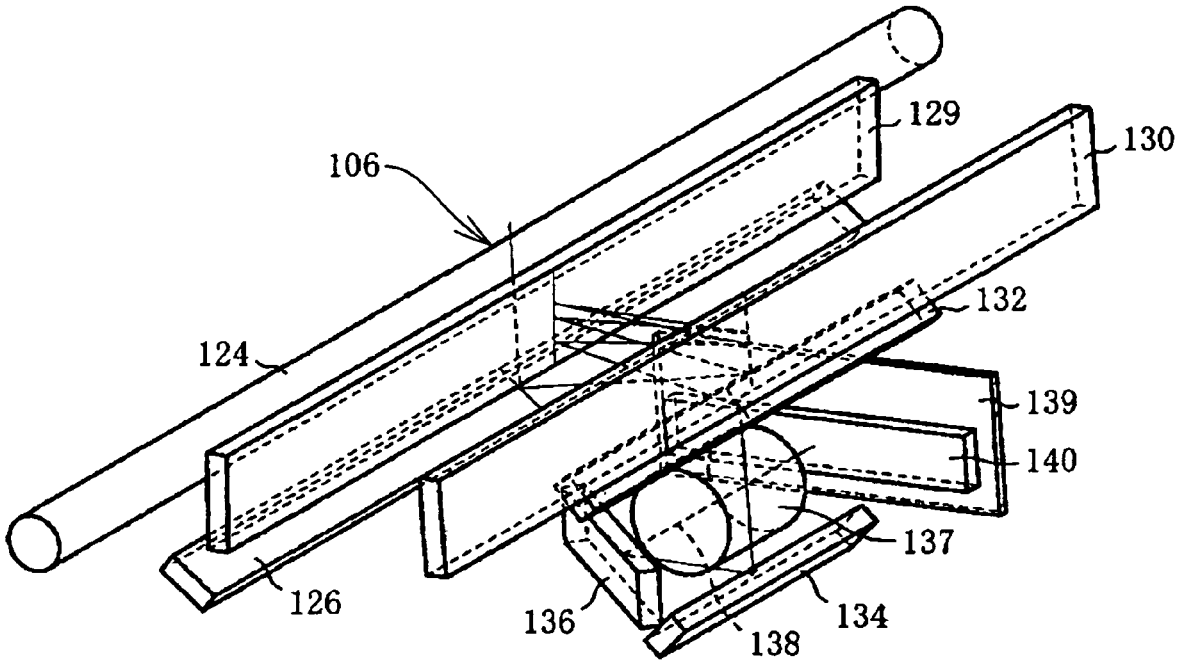
FIG. 2 is a perspective view showing parts arrangement relationship of a major part of the shown embodiment of a scanner module.
Figure 3:
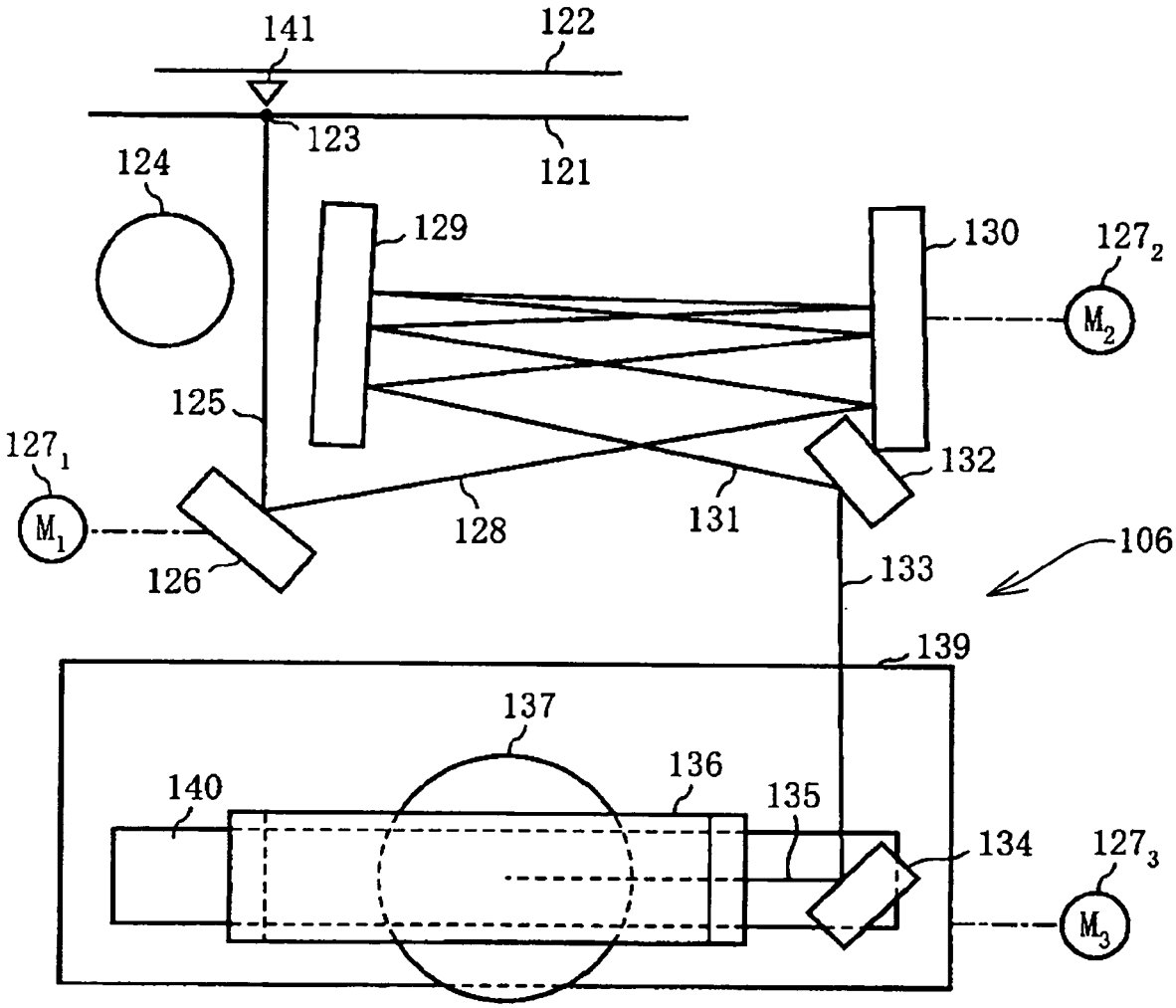
FIG. 3 is a side elevation illustrating a platen glass and the scanner module in the shown embodiment.

FIG. 2 is an illustration showing a relationship of parts arrangement with respect to the major part of the scanner module (optical module) as viewed obliquely upper side, and FIG. 3 is an illustration of the platen glass and the scanner module as viewed from lateral side. The scanner module 106 has a bar-shaped light source 124 illuminating an original 122 on the platen glass 121 including a reading position 123. A reflection light originally emitted from the light source 124 and reflected by the original 122 incides to a first mirror 126 to be reflected obliquely upward. The first mirror 126 has a rotary shaft (not shown) in the longitudinal direction so that rotation angle can be adjusted by means of a first motor ($M_1$) $\mathbf{127}_1$. A reflection light 128 of the first mirror 126 incides to a third mirror 130 among second and third mirrors 129 and 130 arranged in substantially parallel relationship with a predetermined distance. The third mirror 130 has a rotary shaft (not shown) in longitudinal direction for varying times of turning by reflection of the reflection light 128 between the third mirror 130 and the second mirror 129 by rotation over fine angle by means of a second motor ($M_2$) $\mathbf{127}_2$. In case of the example shown in FIGS. 2 and 3, respectively three times of reflection is performed by the second mirror 129 and the third mirror 130.

A final reflection light 131 by the second mirror 129 incides to a fourth mirror 132 arranged immediately below the third mirror 130, and is reflected substantially perpendicularly downward as a reflection light 133. The reflection light 133 is reflected in a direction substantially parallel to the platen glass 121 (FIG. 3) by a fifth mirror 134 as a reflection light 135. The reflection light 135 incides to a sixth mirror 136. A direction of a reflection light 138 by the sixth mirror 136 matches with an optical axis of an image forming lens 137 consisted of a plurality of lenses. The reflection light 138 is converged by the image forming lens 137 to form an image on a linear image sensor 140 consisted of CCD (Charge Coupled Device) fixed on a mounting plate 139 and then subject to photoelectric conversion. In the shown embodiment, the image forming lens 137 is fixed. The first image sensor is driven to move relative to the image forming lens by means of a third motor ($M_3$) $\mathbf{127}_3$ for adjusting a distance to the image forming lens 137. It should be noted that in certain apparatus, a part of first to third motors $\mathbf{127}_1$ to $\mathbf{127}_3$ can be eliminated.

On the other hand, when a magnification for reading the original 122 by the linear image sensor 140 is varied, the reading position 123 can be varied. When the reading position 123 is varied, it becomes necessary to adjust the position to initiate reading per magnification to make control complicate. Therefore, in the shown embodiment of the original reading apparatus, number of times of turning of the reflection light 128 is controlled by the second motor $\mathbf{127}_1$, and in conjunction therewith, by adjusting rotation angle of the first mirror 126, the reading position 123 is kept constant irrespective of magnification. In order to maintain the reading position 123 constant, the sensor 141 is arranged outside of the reading region of the original 122 on the platen glass 121.

Figure 4:
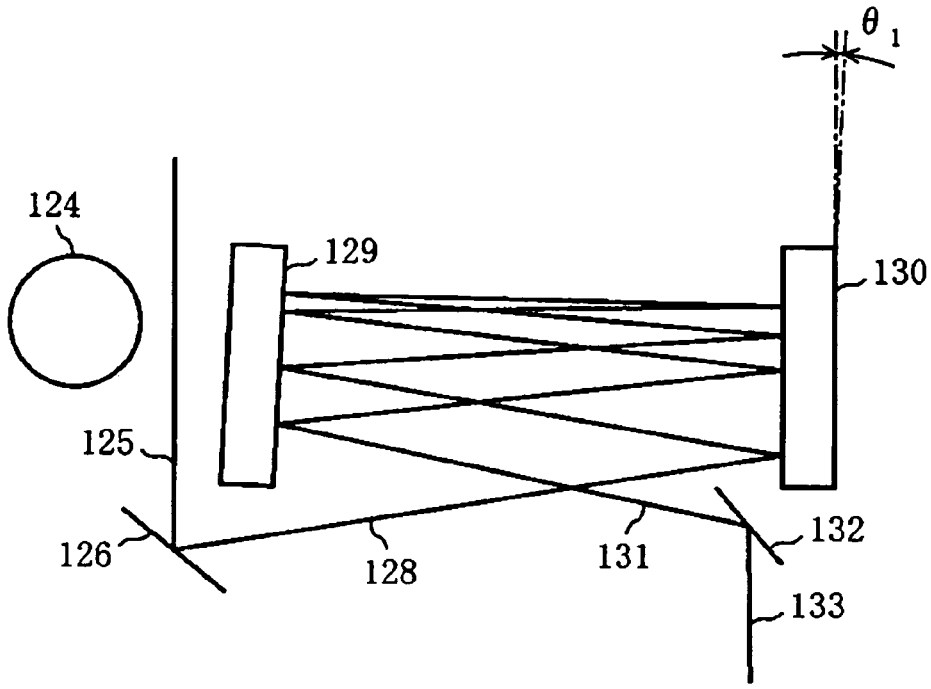
FIG. 4 is an explanatory illustration of the major part of an optical system of the case where number of times of turning of a reflection light by second and third mirrors is eight times in the shown embodiment.
Figure 5:
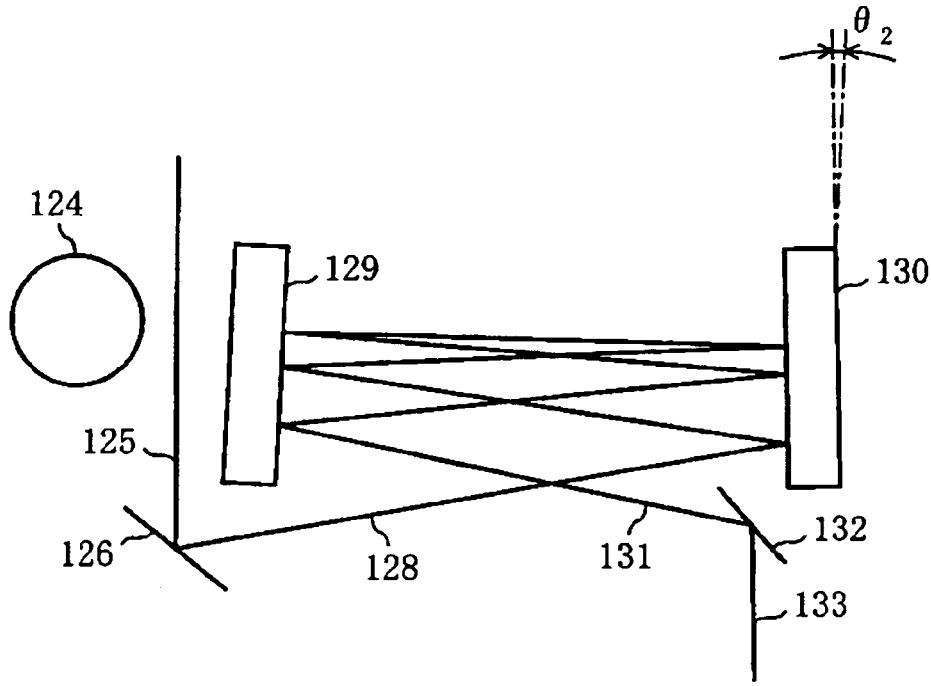
FIG. 5 is an explanatory illustration of the major part of an optical system of the case where number of times of turning of a reflection light by second and third mirrors is six times in the shown embodiment.
Figure 6:
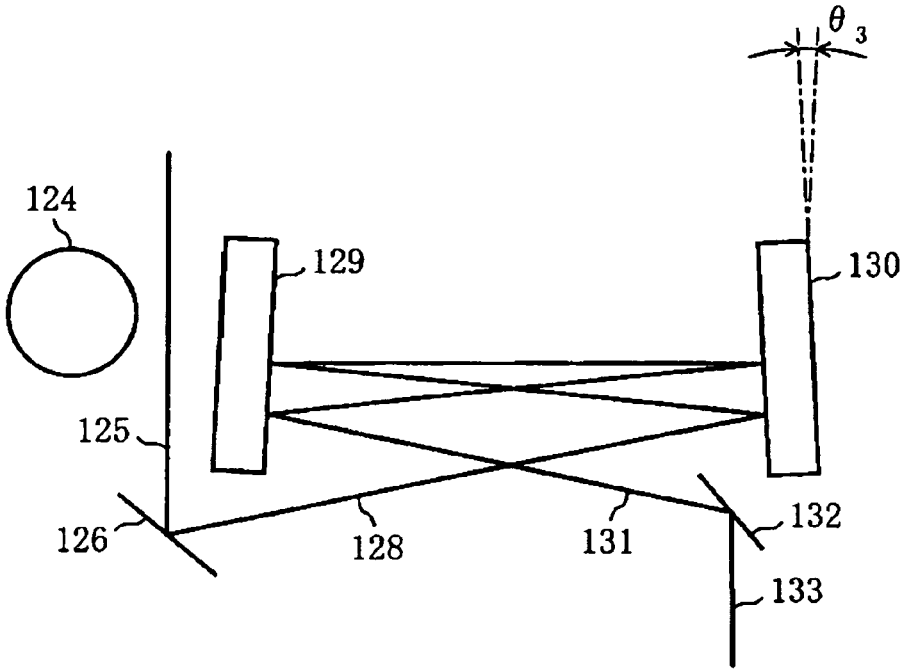
FIG. 6 is an explanatory illustration of the major part of an optical system of the case where number of times of turning of a reflection light by second and third mirrors is four times in the shown embodiment.
Figure 7:
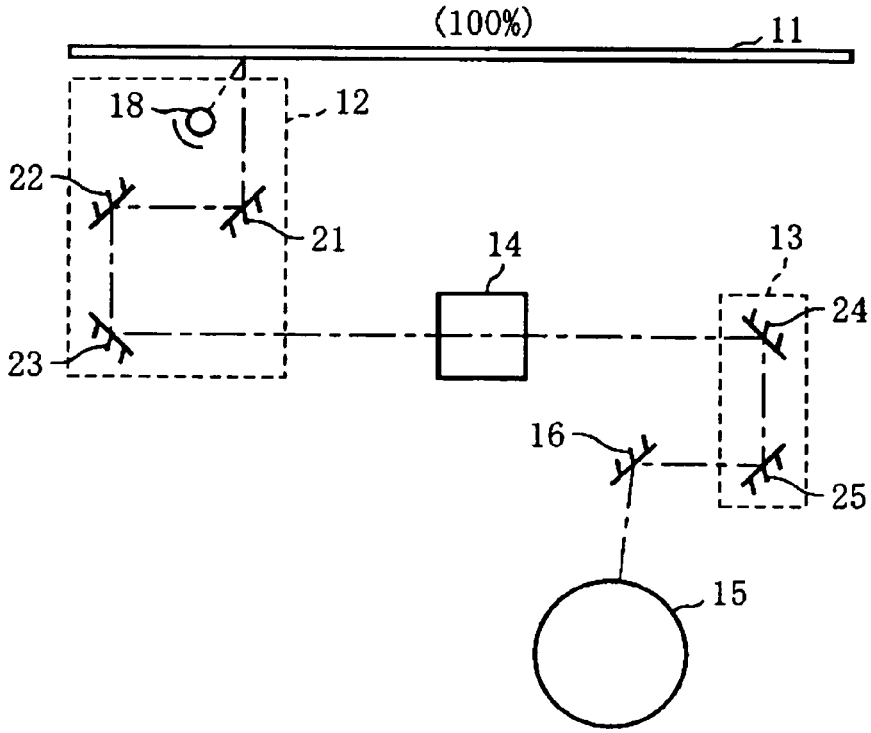
FIG. 7 PRIOR ART
FIG. 7 is an illustration showing a general construction showing arrangement of an optical system of the conventionally proposed copy machine in the case of equal magnification.

FIGS. 4 to 6 show the cases where number of times of turning of the reflection light by the second and third mirrors is varied. Amongst, in FIG. 4, by setting an angle $\theta_1$ of the third mirror 130 relative to the second mirror 129, eight times in total of turning of the reflection light is caused between the second and third mirrors 129 and 130 to elongate an optical length by these optical parts.

On the other hand, in FIG. 5, by setting a tilting angle of the third mirror 130 relative to the second mirror 129 at an angle $\theta_2$ greater than the angle $\theta_1$ of the example of FIG. 4, six times in total of turning of the reflection light is caused between the second and third mirrors 129 and 130 to elongate an optical length by these optical parts.

Furthermore, in FIG. 6, by setting a tilting angle of the third mirror 130 relative to the second mirror 129 at an angle $\theta_3$ greater than the angle $\theta_2$ of the example of FIG. 5, six times in total of turning of the reflection light is caused between the second and third mirrors 129 and 130 to elongate an optical length by these optical parts.

Figure 8:
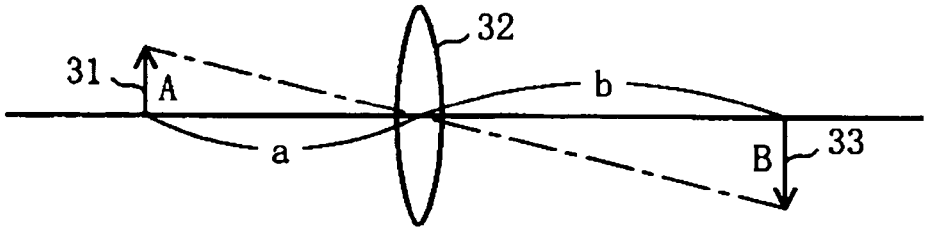
FIG. 8 PRIOR ART
FIG. 8 is an explanatory illustration showing a relationship between a magnification, object, lens and image forming position.
Figure 9:
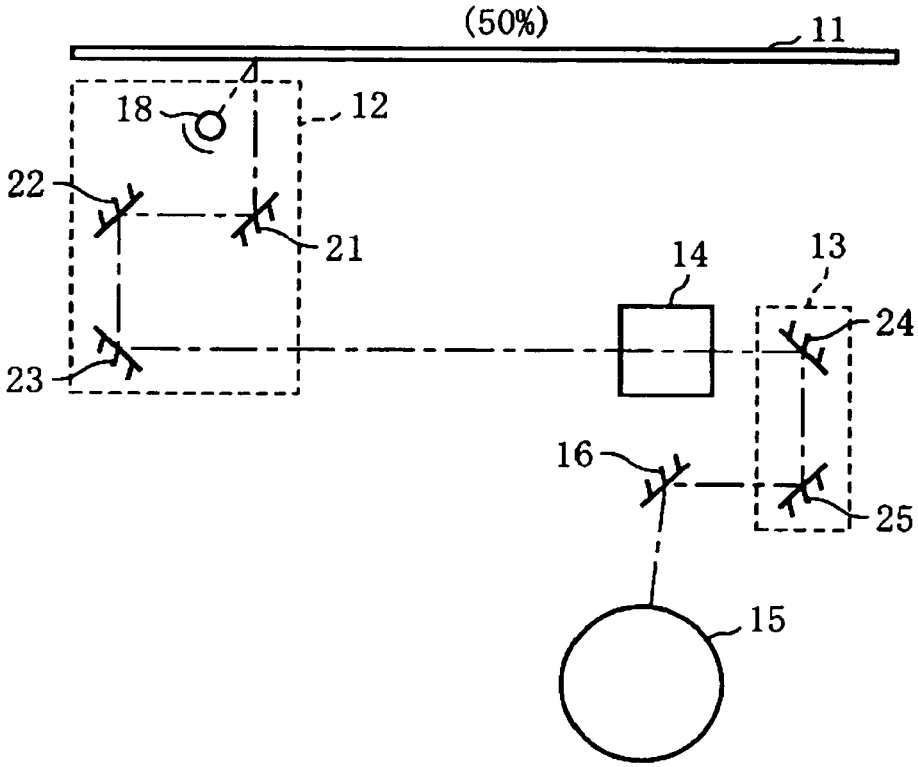
FIG. 9 PRIOR ART
FIG. 9 is an illustration showing a general construction showing an arrangement of an optical system when a magnification set in the copy machine shown in FIG. 7 is 50%.
Figure 10:
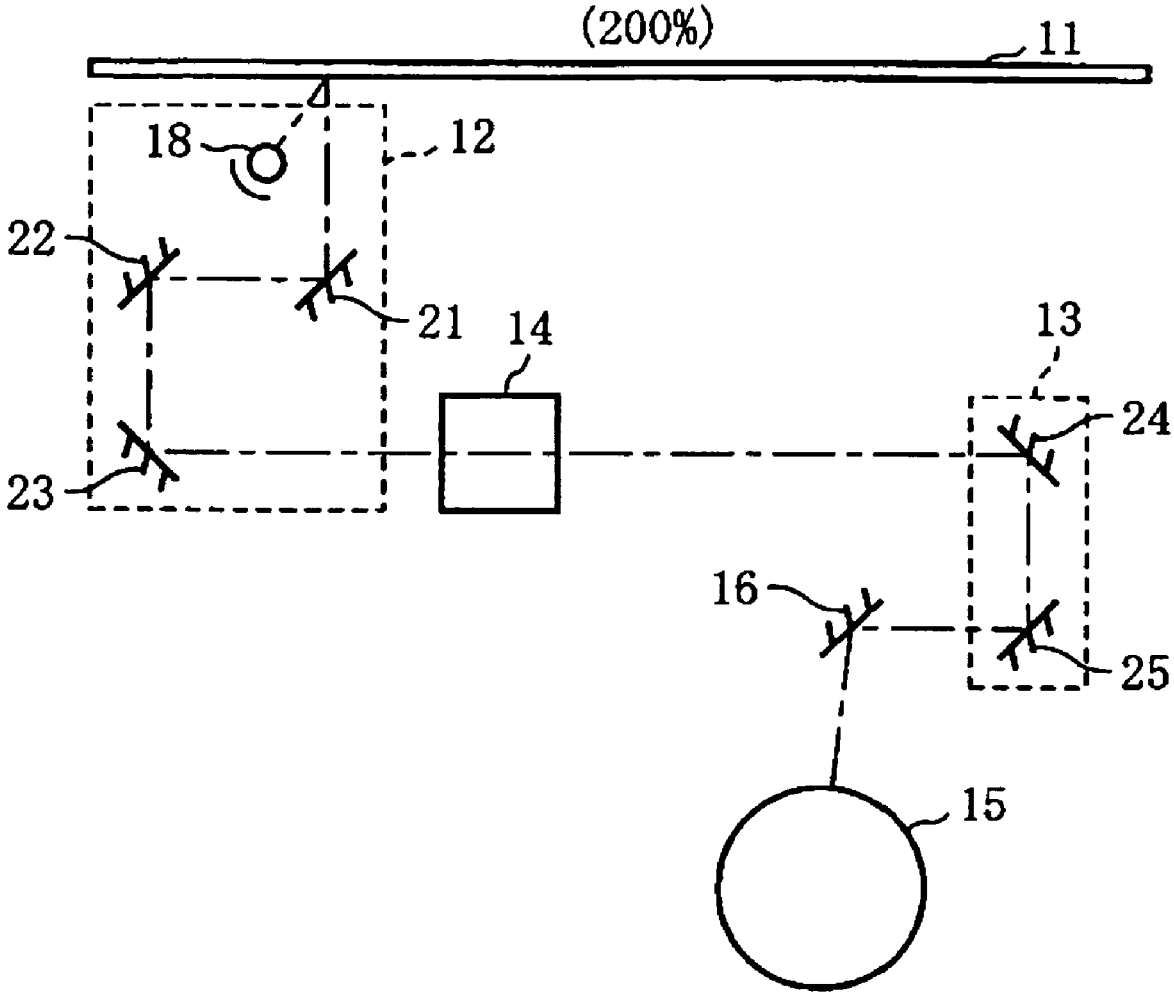
FIG. 10 PRIOR ART
FIG. 10 is an illustration showing a general construction showing an arrangement of an optical system when a magnification set in the copy machine shown in FIG. 7 is 200%.

Here, it is assumed that a distance between the second mirror 129 and the third mirror 130 is constant, and the position of the optical lens 137 or the linear image sensor 140 shown in FIG. 2 or 3, is fixed. In this case, among three examples shown in FIGS. 4 to 6, the optical system shown in FIG. 4 establishes the most compressed magnification, and the optical system shown in FIG. 6 establishes the most expanded magnification. If such assumption is not established, for example, when the position of the linear image sensor 140 is fluctuated by the third motor $\mathbf{127}_3$ as in the shown embodiment, a distance b in a distance ratio b/a shown in FIG. 8 is differentiated. Accordingly, among three examples shown in FIGS. 4 to 6, it is not possible to determine the arrangement of the optical system as to which magnification is to be set.

Therefore, in the shown embodiment of the original reading apparatus 101, when an operator designates a certain magnification through the operating portion 107 shown in FIG. 1, information relating to a rotation angle corresponding to magnification is read out from the not shown ROM (read-only-memory). Then, an angle is set by the second motor $\mathbf{127}_2$. Thereafter, when the first motor $\mathbf{127}_1$ is rotated to adjust the reading position 123 of the original 122, and the third motor $\mathbf{127}_3$ moves the mounting plate 139 for correcting focal position in the relevant magnification. Here, adjustment of the reading position 123 by the first motor $\mathbf{127}_1$ is performed by positioning relative to the sensor 141.

Once adjustment of the optical system is performed as set forth above, in a condition where relationship of arrangement upon completion of adjustment set forth above, the scanner module 106 shown in FIG. 1 is moved in the auxiliary scanning direction perpendicular to the longitudinal direction (primary scanning direction) of the scanner module 106. By this, reading of a two-dimensional image of the original 122 (FIG. 2) is performed.

In case of the shown embodiment of the scanner module 106 as set forth above, after establishing the optical path in parallel to the platen glass 121 (FIG. 3) by the fifth mirror 134, the optical path is deflected into the longitudinal direction of the scanner module 106 by the sixth mirror 136. By this, the moving direction of the optical lens 137 or the linear image sensor 140 becomes the axial direction (primary scanning direction) of scanner module 106. Accordingly, the length in the height direction and auxiliary scanning direction of the scanner module 106 can be shortened to contribute for down-sizing of the module per se.

If there is no positive demand for down-sizing, various modification may be provided in the arrangement of the optical system for guiding the reflected light 133 as shown in FIG. 3. For instance, the linear image sensor 140 may be arranged below the third mirror 130 with orienting the sensor surface upwardly. On the other hand, it is also possible to arrange the linear image sensor 140 in the longitudinal direction of the scanner module 106. By this, number of mirrors can be reduced.

Furthermore, in the embodiment, while the second mirror 129 is fixed, it is also possible to rotate this in place of the third mirror 130. Of course, it is further possible to perform control for rotating both of the second mirror 129 and the third mirror 130.

On the other hand, in the embodiment, discussion has been given for the case where the original 122 is placed in contact with the platen glass 121. In this case, the position of the object can be regarded as substantially the position of the upper surface of the platen glass 121. However, in case of the original reading apparatus having a function for reading the image on the photo film, it is typical to mount a stripe form film on the platen glass 121 with setting in a not shown film holder. In such case, for a height of the portion where the film is set with the film holder, the film as the object is lifted away from the platen glass 121. Accordingly, when the film holder is used, focal depth should be deepened for lifting amount or position or respective portions should be adjusted with taking the lifting amount into account.

Furthermore, in the embodiment, there are shown examples to turn the optical paths for four to eight times between two mirrors. However, number of times of turning between these mirrors can be two or three times or more than eight times. On the other hand, at the final image forming position, it is naturally possible to arrange other reading means, such as photosensitive body or the like, or an image recording means in addition to the linear image sensor.

As set forth above, with the present invention, angle or angles of reflection surface or reflection surfaces of one or both of first and second magnification varying mirrors are varied by reflection times setting means for varying the optical path length depending upon the original reading magnification to realize variation among a plurality of magnifications in stepwise manner or sequential manner. Therefore, down-sizing of the original reading apparatus can be accomplished in the extent corresponding to the extent of variation of the optical path length by turning. Since number of times of reflection of the reflection light between the first magnification varying mirror and the second magnification varying mirror is varied depending upon reading magnification of the original, substantial down-sizing of the space to be occupied by the optical system can be achieved even in the optical system where the optical path length is varied significantly.

Also, with the present invention, since the angle or angles of one or both of the first and second magnification varying mirrors by rotating the motor in the magnitude depending upon original reading magnification set in the operating portion, variation of number of times of turning of the reflected light depending upon the original reading magnification can be done easily.

With the present invention, since the image of the original is read by reciprocally moving the optical module including the first and second magnification varying mirrors, the optical lens and the linear image sensor, in the auxiliary direction after permitting setting of number of times of turning of the reflection light between the first and second magnification varying mirrors, the optical module can be further down-sized to contribute for down-sizing of the overall original reading apparatus.

With the present invention, since the optical lens is fixed and the linear image sensor side is moved by the linear image sensor moving means, the image of the reading position of the original can be accurately formed at the image reading position.

With the present invention, since the reading position adjusting means for adjusting the reading position in the auxiliary scanning direction by controlling rotation angle of the position adjusting reflection mirror, reading start position can be maintained constant even when magnification is differentiated. On the other hand, at the stage where a the optical module is set at home position as the original reading start position for example, it is also possible to read image information of the member for shading correction using the reading position adjusting means as required. Namely, advantage is accomplished to avoid necessity of varying control of the shifting position of the optical module between the case where the shading correction is performed and the case where the shading correction is not performed.

Also, with the present invention, since the reading position of the original is set at a position away from the surface position of the platen glass, focused image can be obtained even when the film holder is set on the platen glass or when a three-dimensional image, such as thick book or the like is to be read.

Furthermore, with the present invention, by deflecting the light reflected from the second magnification varying mirror in the longitudinal direction of the optical module using the optical path varying means, when the linear image sensor is small in certain extent, length of the optical module in the auxiliary scanning direction can be set shorter. As a result, the length of the original reading apparatus in auxiliary scanning direction can be shortened. On the other hand, by deflecting the light in parallel to the platen glass instead of downward direction of the platen glass perpendicular to the optical module, length of the optical module in this direction can be shortened to reduce thickness of the original reading apparatus.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An original reading apparatus comprising:

a first magnification varying mirror disposed in an optical path from a reading position of an original to an image sensor disposed in said optical path after an image forming lens, and reflecting a light from said reading position of the original;

a second magnification varying mirror arranged in opposition to a reflection surface of said first magnification varying mirror and reflecting said light reflected from said first magnification varying mirror a plurality of times between said first and second magnification varying mirrors, and thereafter reflecting said light in said optical path toward said image forming lens; and a mirror positioning means for setting a number of times said light is reflected between said first and second magnification varying mirrors by varying an angle of said reflection surface of at least one of said first and second magnification varying mirrors.

2. The original reading apparatus as set forth in claim 1, wherein said mirror positioning means varies said angle of said reflection surface of at least one of said first and second magnification varying mirrors by rotating a motor in a magnitude corresponding to the original reading magnification set by an operating portion.

3. The original reading apparatus as set forth in claim 1, wherein said image sensor is set in an image forming portion, said first and second magnification varying mirrors, said image forming lens, and an image sensor are assembled as an optical module, wherein said optical module is shifted in an auxiliary scanning direction perpendicular to a primary scanning direction when said image sensor performs the reading of an image on said original in said primary scanning direction per one line.

4. The original reading apparatus as set forth in claim 3, wherein said image forming lens is positionally fixed within said optical module, and further comprises an image sensor positioner for moving a reading position of the image of said image sensor depending upon the original reading magnification.

5. The original reading apparatus as set forth in claim 3, which further comprises a position adjusting mirror disposed in said optical path between said reading position of said original and said first magnification varying mirror, and an original reading position for adjusting the original reading position in the auxiliary scanning direction by controlling a rotation angle of said position adjusting mirror.

6. The original reading apparatus as set forth in claim 1, wherein said original reading position is located on the surface of a platen glass, on which the original is mounted.

7. The original reading apparatus as set forth in claim 1, wherein said original reading position is located at a position away from a surface of a platen glass.

8. The original reading apparatus as set forth in claim 3, which further comprises a reflecting surface disposed in said optical path between said second magnification varying mirror and said optical module for reflecting said light reflected from said second magnification varying mirror to a longitudinal direction of said optical module, wherein said image forming lens is arranged between said reflecting surface and said linear image sensor.

9. The original reading apparatus as set forth in claim 5, wherein said original reading position positioner adjusts the reading position of the original for shading correction.

* * * * *